US006966274B2

(12) United States Patent
Eck

(10) Patent No.: US 6,966,274 B2
(45) Date of Patent: Nov. 22, 2005

(54) WATER SPORT IMPLEMENT LEVERAGE SYSTEM

(75) Inventor: Richard E. Eck, Minneapolis, MN (US)

(73) Assignee: Bombardier Recreational Products Inc., Verdun (CA)

( * ) Notice: Subject to any disclaimer, the term of this patent is extended or adjusted under 35 U.S.C. 154(b) by 0 days.

(21) Appl. No.: 10/813,041

(22) Filed: Mar. 31, 2004

(65) Prior Publication Data

US 2004/0187760 A1 Sep. 30, 2004

Related U.S. Application Data

(60) Provisional application No. 60/458,368, filed on Mar. 31, 2003.

(51) Int. Cl.[7] ..... B63B 17/00
(52) U.S. Cl. ..... 114/364; 114/253
(58) Field of Search ..... 114/218, 253, 258, 114/362, 364; 441/68, 74; 248/235

(56) References Cited

U.S. PATENT DOCUMENTS 3,857,127 A * 12/1974 Hendrickson ..... 114/362
4,417,539 A * 11/1983 Thompson ..... 114/381
4,548,155 A * 10/1985 Hegg et al. ..... 114/362
5,979,350 A * 11/1999 Larson et al. ..... 114/253
6,125,783 A * 10/2000 Shimmell, Sr. et al. ..... 114/343
6,314,902 B1 * 11/2001 Jessen et al. ..... 114/259

* cited by examiner

*Primary Examiner*—Lars A. Olson
(74) *Attorney, Agent, or Firm*—BRP Legal Services

(57) ABSTRACT

A watercraft for towing a performer equipped with a water sport implement having a support surface on a deck thereof adapted to support a water sport implement and a performer of the water sport for the performer to put on the water sport implement.

A first abutment is secured to the watercraft and protrudes with respect to the support surface of the watercraft, such that a water sport implement laid on the support surface is abutted against the first abutment when a performer is putting on the water sport implement.

14 Claims, 9 Drawing Sheets

WATER SPORT IMPLEMENT LEVERAGE SYSTEM

The present application claims priority to U.S. Provisional Application of Eck et al., Ser. No. 60/458,368, filed Mar. 31, 2003, the entirety of which is hereby incorporated into the present application by reference.

BACKGROUND OF THE INVENTION

1. Field of the Invention

The present invention generally relates to water sports and, more particularly, to watercraft used for towing a performer of the water sport.

2. Background Art

One popular form of water sport has a performer towed by a watercraft skimming the surface of the water. The performer so towed performs a slalom motion with respect to the path of the watercraft, performs aerial manoeuvres, for example, by using the wake of the watercraft, or simply follows the path of the watercraft.

Water sport implements used for such water sports come in various types. Two well known implements amongst these types are water skis and wakeboards. Water skis come in pairs, or as monoskis, wherein both feet are secured to one ski. As a general rule, when a pair of skis is used, both feet are generally parallel to a longitudinal axis of the ski, and when a monoski is used, the forefoot is generally parallel to a longitudinal axis of the ski. Wakeboards have less of an elongated shape than skis, and are used with both feet planted generally transversely to the longitudinal axis of the board. While greater speeds can be attained with skis, wakeboards are more frequently used to perform the aerial manoeuvres.

Both these water sport implements have bindings in order to secure the feet of the performer to the board/ski. Taking into consideration the forces resulting from the skimming of the water sport implement on the water and the speeds attained by the watercraft, the bindings must ensure that the performer is safely anchored onto the water sport implement. Therefore, some bindings completely cover/wrap the feet of the performer. Putting on the bindings includes fitting the feet. into the bindings and adjusting the bindings to obtain a suitable anchoring so as to prevent dislodging of the feet of the performer while being towed by the watercraft. The performer usually prefers leaning on a solid surface to put on the bindings. The performer may, for instance, be docked before his performance, or may use the deck of the watercraft to put on the bindings of the water sport implement. In this latter case, the watercraft is not always very stable, making it difficult to put on the bindings. The performer may also slip into the bindings while being kept afloat by a buoyant jacket, but this involves some skill, and could result in the feet not being suitably anchored to the water sport implement. Therefore, there is a need in the art for an apparatus to aid a performer in putting on a water sport implement.

SUMMARY OF INVENTION

It is therefore an aim of the present invention to provide a system to aid a water sport performer in putting on water sport implements.

It is a further aim of the present invention to provide a method for installing the system to a watercraft.

Therefore, in accordance with the present invention, there is provided a system for providing support to a water sport performer in putting on a binding of a water sport implement on a watercraft, comprising an abutment, and a fastener for securing the abutment in a given position with respect to a support surface of a deck of a watercraft with the abutment protruding from the support surface of the watercraft, such that a water sport implement laid on the support surface is abutted against the abutment for providing stability to a performer in putting on a binding of the water sport implement.

Also in accordance with the present invention, there is provided a watercraft for towing a performer equipped with a water sport implement to skim the surface of a body of water, comprising a watercraft actuatable to tow a performer, the watercraft having a support surface on a deck thereof adapted to support a water sport implement and a performer of the water sport for the performer to put on the water sport implement, and a first abutment secured to the watercraft and protruding with respect to the support surface of the watercraft, such that the water sport implement laid on the support surface is abutted against the first abutment for providing stability to a performer in putting on a binding of the water sport implement.

Further in accordance with the present invention, there is provided a method for installing a system for providing support to a water sport performer in putting on a binding of a water sport implement on a support surface of a watercraft, comprising the steps of: i) providing a first abutment and a fastener; and ii) fastening the first abutment with the fastener in a given position with respect to the support surface of the watercraft with the first abutment protruding with respect to the support surface of the watercraft, such that a water sport implement laid on the support surface is abutted against the first abutment for providing stability to the performer putting on a binding of the water sport implement.

BRIEF DESCRIPTION OF THE DRAWINGS

Having thus generally described the nature of the invention, reference will now be made to the accompanying drawings, showing by way of illustration a preferred embodiment thereof and in which.

DESCRIPTION OF THE PREFERRED EMBODIMENTS

Figure 1:
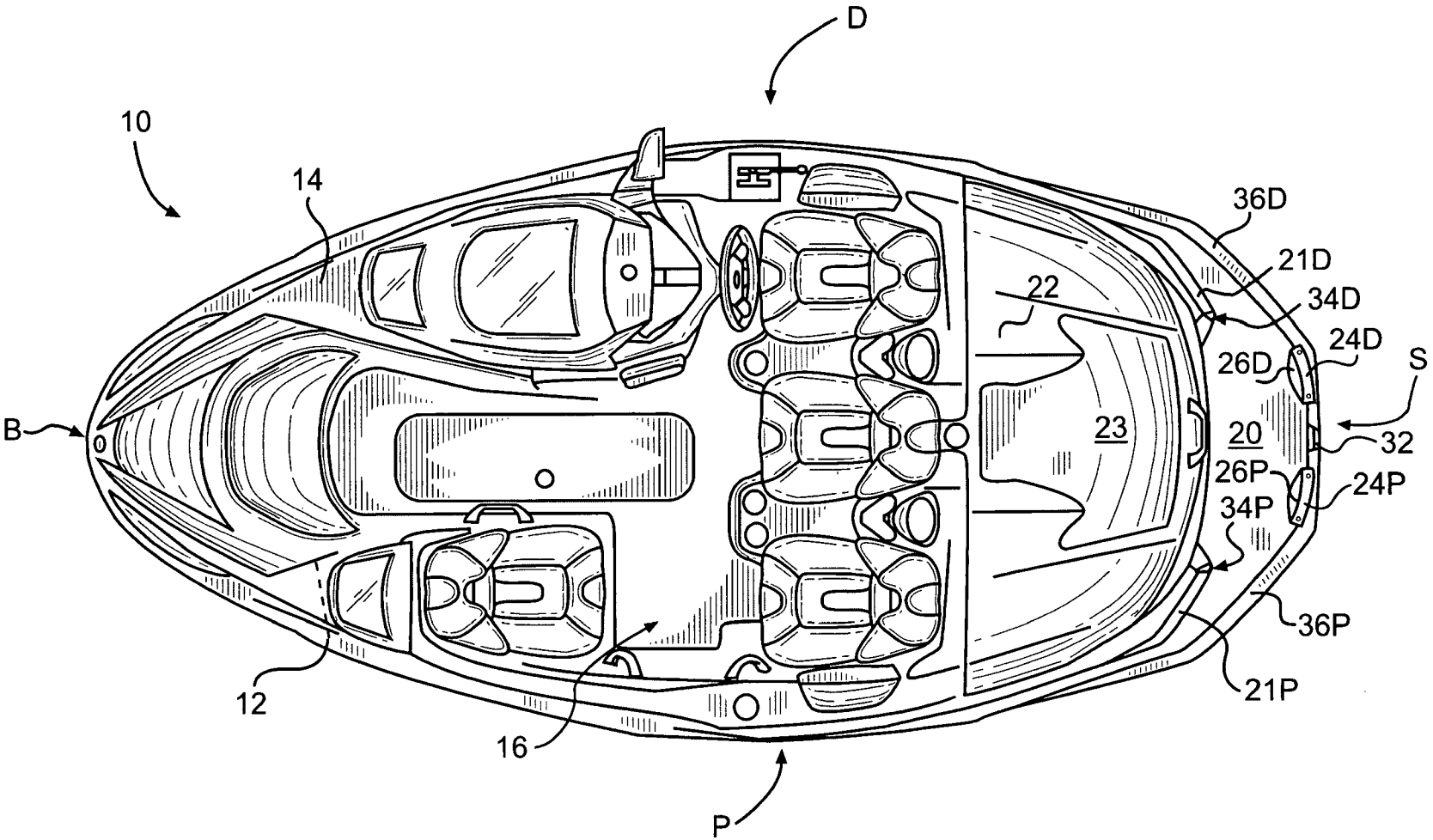
FIG. 1 is a top plan view of a watercraft having a water sport implement leverage system in accordance with the present invention.
Figure 2:
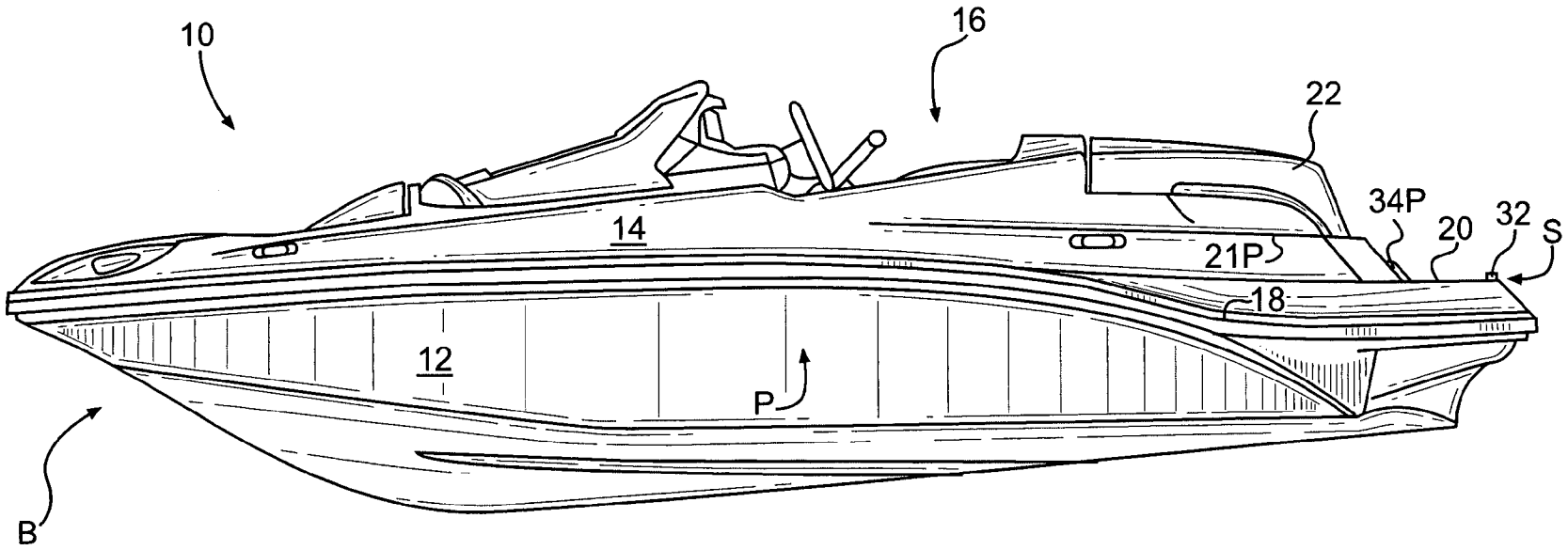
FIG. 2 is a side elevational view of the watercraft of FIG. 1.

Referring to the drawings, and more particularly to FIGS. 1 and 2, a watercraft, having a water sport implement leverage system in accordance with the present invention, is generally shown at 10. The watercraft 10 has a bow B, a stern S, a port P and a starboard D. The watercraft 10 has two main parts, namely a hull 12 and a deck 14. The hull 12 buoyantly supports the watercraft 10 in the water. The deck 14 has a recessed passenger area 16 designed to accommodate passengers. The hull 12 and the deck 14 are drawn together at bond line 18. An engine (not shown) is disposed between the hull 12 and the deck 14. The engine is operatively coupled to a propulsion unit (not shown) to propel the watercraft 10.

An aft portion of the watercraft 10, between the recessed passenger area 16 and the stern S, defines a generally planar surface 20. Edge portions 21, affixed with a "D" or a "P" in FIG. 2 to indicate respectively the starboard side or the port side, protrude upwardly from the planar surface 20. It is pointed out that like elements positioned on opposed sides of the watercraft 10 will be affixed with letters "D" and "P" in the figures to indicate the starboard side or the port side. An engine cover 22 sits on the edge portions 21, and is hinged to the deck 14 for engine access. The engine cover 22 has a padded portion 23 (FIG. 2) to accommodate a person in a sitting or lying position when the watercraft 10 is not in operation.

Figure 3:
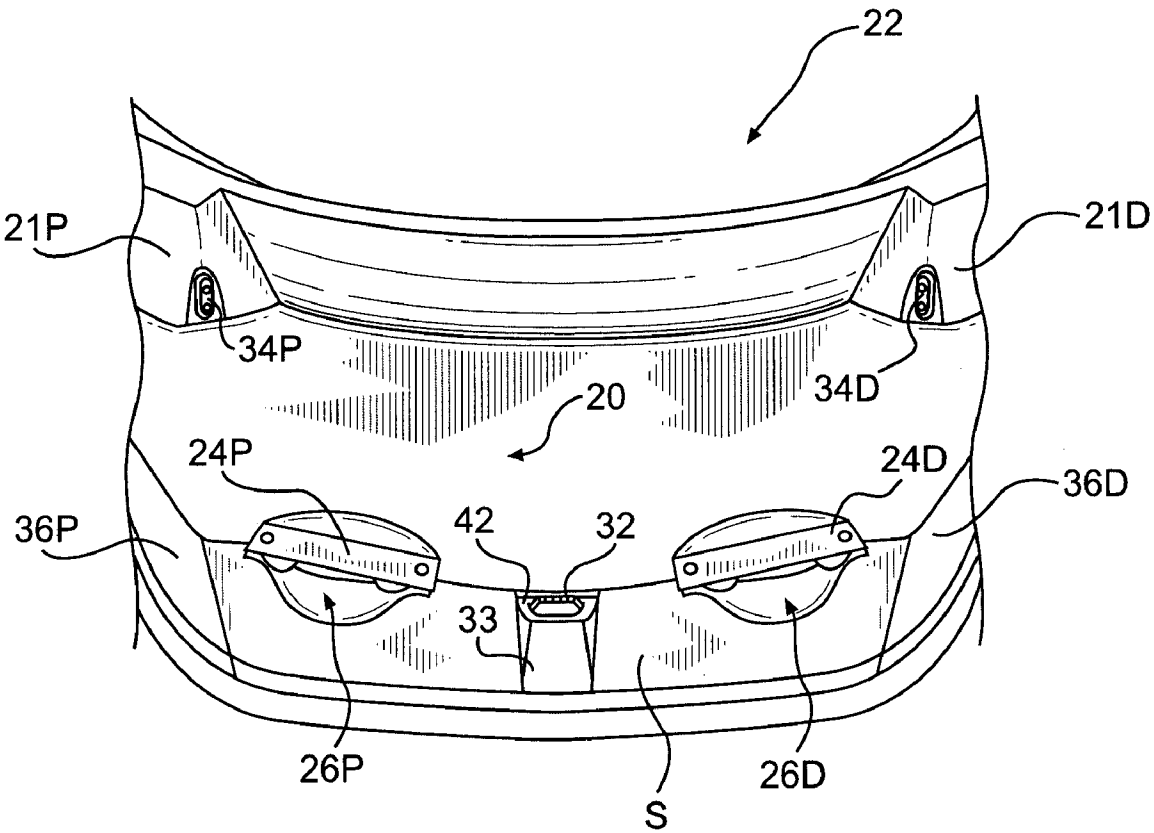
FIG. 3 is an enlarged top rear perspective view of a stern of the watercraft, illustrating the leverage system of the present invention.

Referring to FIG. 3, the surface 20 is shown from a stern view, and has a pair of handles 24 bridging depressions 26. The handles 24 are coplanar with the surface 20, and are provided to help bathers climb into the watercraft 10. The water sport implement leverage system in accordance with the present invention has a protruding abutment 32 aft of the surface 20. The abutment 32 is atop a tail 33 protruding aft in the deck 14. Abutments 34 are provided at aftmost edges of the edge portions 21. As shown in FIG. 3, the deck 14 is shown having slanted edge portions 36 between the surface 20 and the bond line 18.

Figure 4:
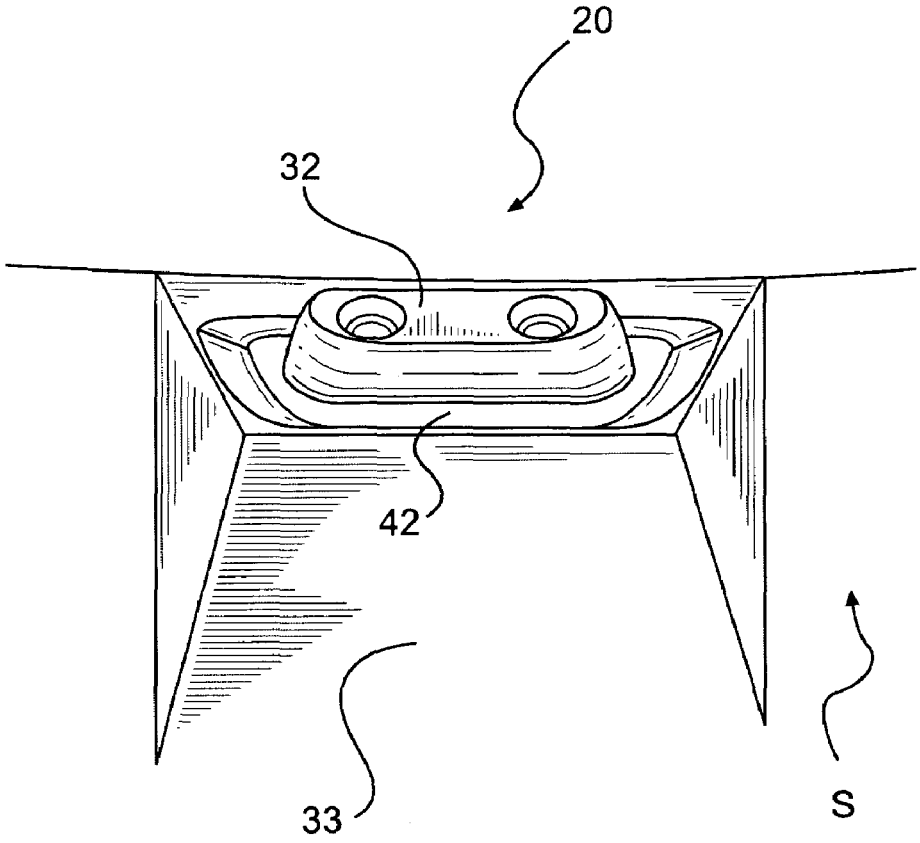
FIG. 4 is a top rear perspective view of a protruding abutment of the leverage system of the present invention.

Referring to FIG. 4, the protruding abutment 32 is shown having an elongated shape of oblong horizontal cross-section, and also shows slight flaring from top to bottom (e.g., also referred to as a grommet). The protruding abutment 32 consists of a resilient material, such as a rubber or other such polymer, and is preferably fixed to the surface 20 of the watercraft 10, for instance, by way of fasteners, such as bolts and nuts, rivets or the like, or of a suitable adhesive. The tail 33 is shown defining a depression 42 that accommodates a bottom of the protruding abutment 32. The protruding abutment 32 could also be secured directly onto the surface 20. The abutments 34 have a similar configuration and are also fixed to the watercraft 10. The abutments 34 are at the intersection of the surface 20 and the edge portions 21.

Figure 5:
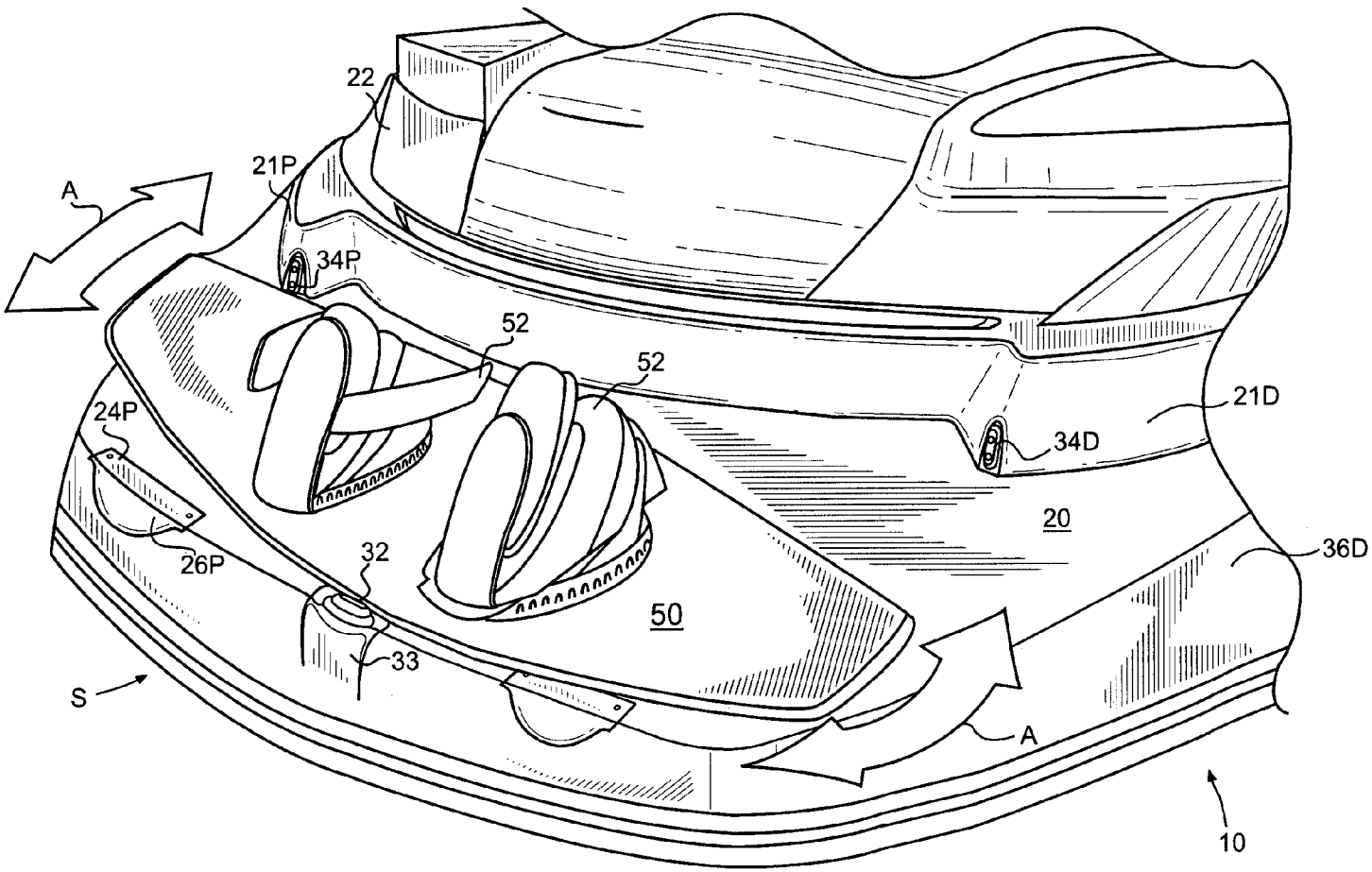
FIG. 5 is a top side rear perspective view of a water-sport implement retained for leverage in the leverage system of the present invention.

Referring to FIG. 5, there is illustrated a method of using the leverage system of the present invention to slip into bindings of water sport implements. In FIG. 5, a wakeboard 50 is illustrated having bindings 52. The wakeboard 50 also defines a fin on its underside, yet not visible in FIG. 5. In order to use the leverage system of the present invention, the wakeboard 50 is laid onto the surface 20 of the deck 14. Opposed longitudinal edges of the wakeboard 50 are held between the protruding abutment 32 and one of the abutments 34, i.e., the abutment 34P in FIG. 5. In this captive position of the wakeboard 50 with respect to the abutments 32 and 34, a performer (not shown) has the wakeboard 50 immobilized so as to slip his left foot into the corresponding binding 52, the corresponding binding 52 being on the starboard side D in FIG. 5. As shown by arrows A, the wakeboard 50 is pivoted thereafter to hold the wakeboard 50 captive between the abutment 32 and the abutment 34D so as to enable the insertion of the right foot of the performer into the free binding 52. Obviously, the performer may perform the above-described steps in a reverse order, with the right foot being slipped into the corresponding binding 52 first, then followed by the left foot.

Figure 6:
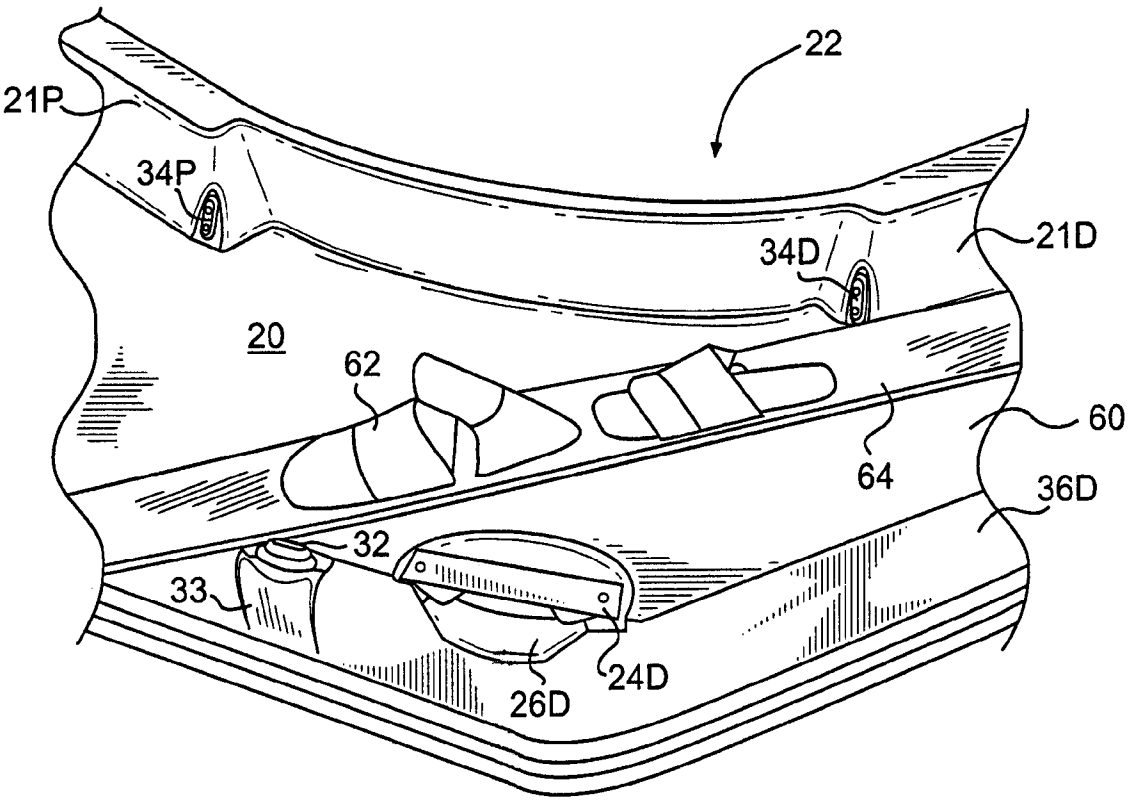
FIG. 6 is a top side rear perspective view of another water sport implement retained for leverage in the leverage system of the present invention.
Figure 7:
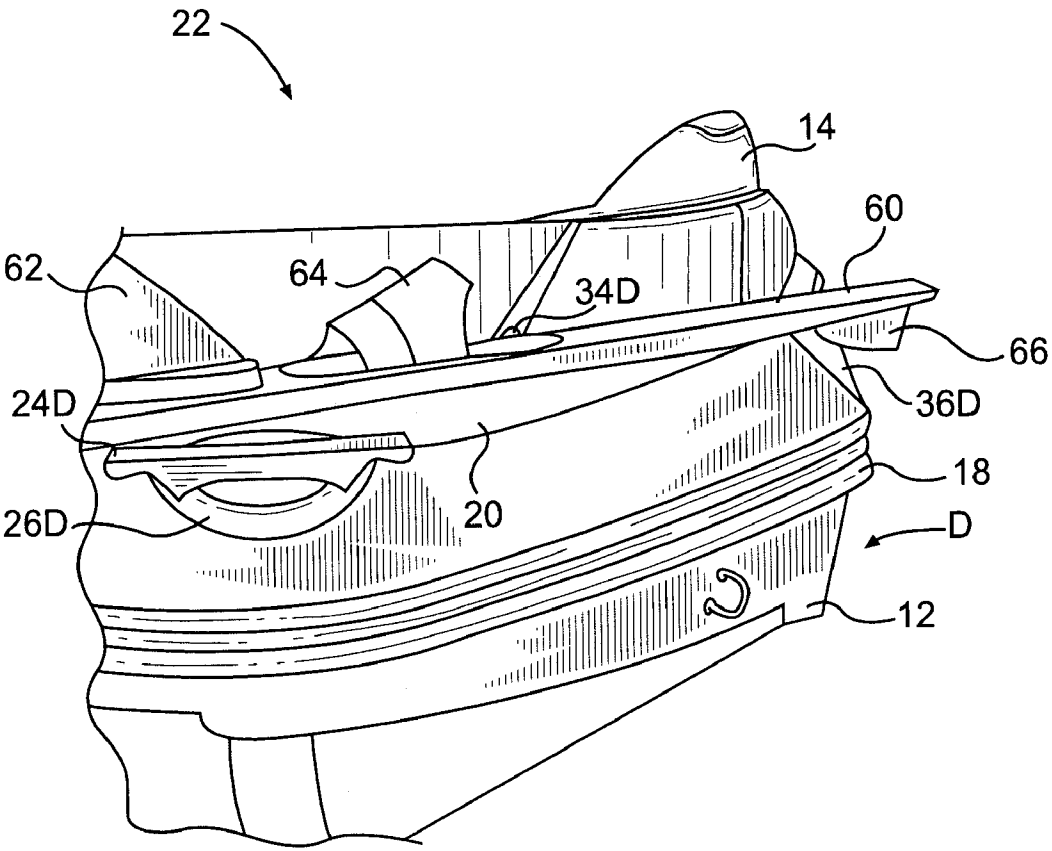
FIG. 7 is an enlarged partial rear elevational view of the stern of the watercraft with the water sport implement of FIG. 6 thereon.

Referring to FIG. 6, another water sport implement, a monoski 60, is shown held captive between the protruding abutment 32 and one of the abutments 34, namely the abutment 34D. The monoski 60 has a front binding 62 and a rear binding 64. A fin 66 (FIG. 7) is provided on the bottom rear end surface of the monoski 60. With the monoski 60 held captive by the leverage system, the performer may slip into the bindings 62 and 64 from a sitting position on the padded portion 23 of the engine cover 22, or simply by standing on the surface 20. The slanted edge portions 36 provide clearance for the fin 66 of the water sport implement 60 to allow the latter to be more centrally positioned on the surface 20, and thus, e.g., enable the performer to be seated on the padded portion 23 while getting geared up with the water sport implement 60.

The above description illustrates the preferred embodiment of the leverage system of the present invention, but the latter may adopt other suitable forms. Firstly, abutments such as the abutment 32 may be provided on any generally planar surface adjacent to edges of the watercraft that could be used for slipping into water sport implements of the types described herein. It is, however, preferable to provide such a leverage system at the stern S.

Although it is preferred to have more than one abutment, such as the abutments 32 and 34, a watercraft could be suitably provided with a single abutment 32. For example, the water sport implement could be held between the abutment 32 and a portion of the deck 14.

The abutments 34 protect the deck 14 (typically made of a fiberglass molding with paint coatings) from the edges of the water sport implement. On the other hand, it is preferred that the abutments 32 and 34 be resilient so as not to damage edges of the watercraft implements. Considering that the watercraft will be subjected to the sun and to water, the material of the abutments 32 and 34 must be chosen not to age or change characteristics prematurely under these conditions.

Figure 8:
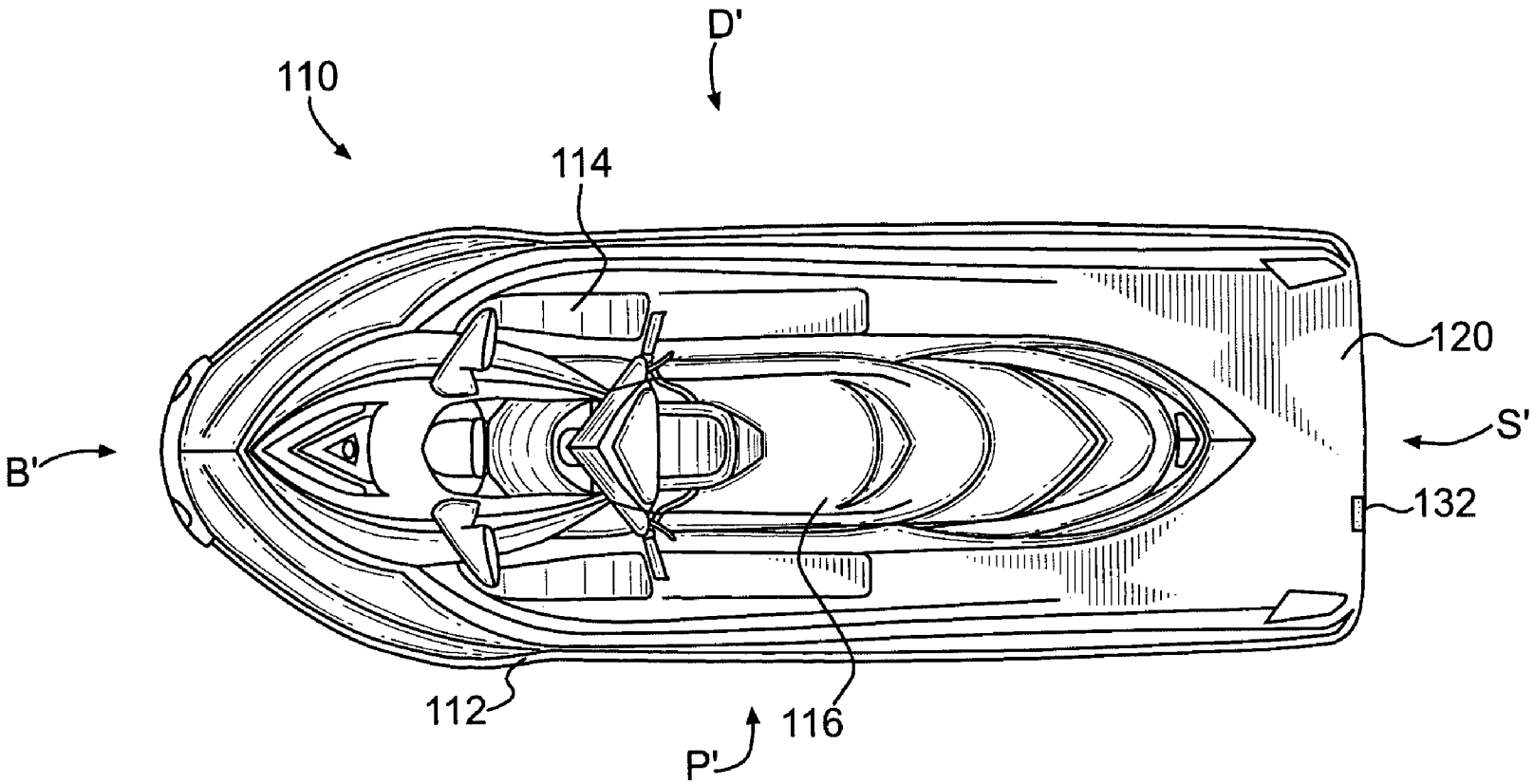
FIG. 8 is a top plan view of a personal watercraft having the leverage system of the present invention.
Figure 9:
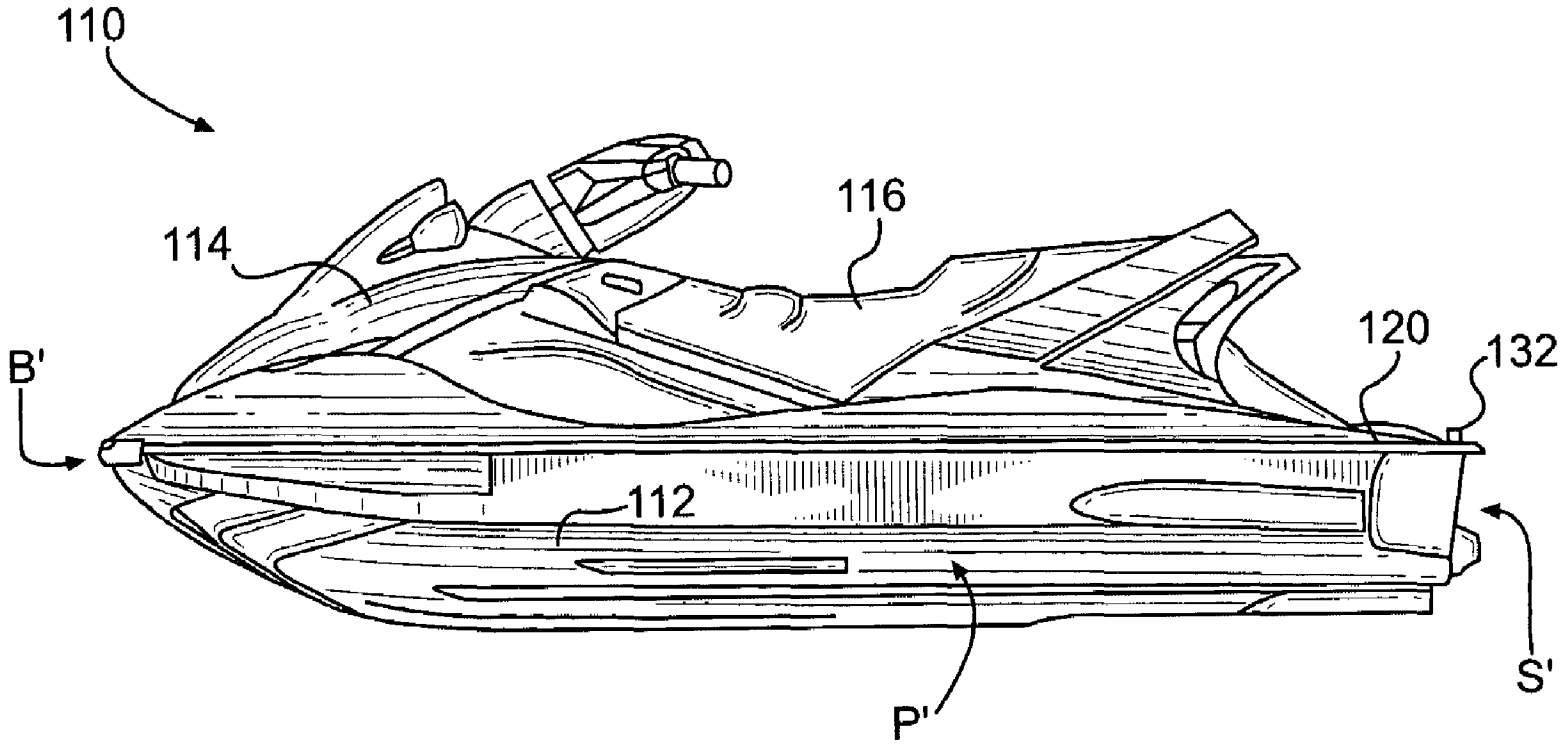
FIG. 9 is a side elevational view of the personal watercraft of the FIG. 8.

The leverage system of the present invention, although shown and described above for a midsize watercraft (e.g., jet boat), may also be used with a personal watercraft. Referring to FIGS. 8 and 9, a personal watercraft having the leverage system in accordance with the present invention is generally shown at 110. The personal watercraft 110 includes a bow B', a stern S', a port P' and a starboard D'. Similarly to the watercraft 10, the personal watercraft 110 has a hull 112 and a deck 114, with the hull 12 buoyantly supporting the personal watercraft 110 on the water. A driver/passenger seat is generally shown at 116. An engine (not shown) is disposed between the hull 112 and the deck 114. The engine is operatively coupled to a propulsion unit (not shown) to propel the personal watercraft 110.

An aft portion of the personal watercraft 110, between the passenger seat 116 and the stern S', defines a generally planar surface 120, where an abutment, such as the abutment 32 of the above described leverage system, may be positioned. As an example, an abutment 132 is shown protruding from the generally planar surface 120, to provide leverage to a performer slipping into a water sport implement. A water sport implement laid on the generally planar surface 120 overhangs edges of the deck 112, whereby the fin of the water sport implement will not interfere with the deck 112.

Although the above description contains specific examples of the present invention, these should not be construed as limiting the scope of the invention but as merely providing illustrations of some of the presently preferred embodiments of this invention. Thus, the scope of the invention should be determined by the appended claims and their legal equivalents rather than by the examples given.

I claim:

1. A watercraft capable of towing a water sport implement comprising:

a hull;

a deck disposed on the hull;

a support surface on the deck adapted to support a water sport implement and a performer of the water sport to allow the performer to put on the water sport implement;

a slanted surface adjacent to the support surface;

the slanted surface providing clearance for a fin of the water sport implement laid on the support surface; and a first abutment secured to the deck and protruding with respect to the support surface, such that the water sport implement laid on the support surface may abut against the first abutment to aid the performer in putting on the water sport implement.

2. The watercraft according to claim 1, further comprising:

a second abutment secured to the deck;

the second abutment protruding from the support surface and spaced apart from the first abutment, wherein the water sport implement laid on the support surface may be held captive between the first and second abutments to aid the performer in putting on the water sport implement.

3. The watercraft according to claim 1, wherein the support surface is positioned at the stern of the watercraft, and the first abutment is aft of the support surface with respect to the watercraft.

4. The watercraft according to claim 2, further comprising:

a third abutment secured to the deck;

the third abutment protruding from the support surface and spaced apart from the first abutment, wherein the second and third abutments are positioned port and starboard of the first abutment respectively.

5. The watercraft according to claim 2, wherein the first and second abutments consist of a resilient material.

6. The watercraft according to claim 4, wherein the water sport implement laid on the support surface may be held captive between the first and third abutments to aid the performer in putting on the water sport implement.

7. A watercraft comprising:

a bow;

a stern;

a hull;

a deck disposed on the hull;

a support surface on the deck;

a first abutment secured to the deck and protruding with respect to the support surface; and a second abutment secured to the deck, such that a straight line extending through the first and second abutments parallel to the support surface is skewed relative to a longitudinal axis of the watercraft and such that a water sport implement laid on the support surface may be held captive between the first and second abutments to aid a performer in putting on the water sport implement.

8. The watercraft of claim 7, wherein the support surface is positioned at the stern of the watercraft.

9. The watercraft of claim 7, wherein the deck has a generally vertically extending surface and the second abutment is secured to the generally vertically extending surface.

10. The watercraft of claim 7, further comprising a third abutment secured to the deck.

11. The watercraft of claim 7, wherein the second abutment is disposed port of the first abutment and the third abutment is disposed starboard of the first abutment.

12. A watercraft comprising:

a bow;

a stern;

a hull;

a deck disposed on the hull;

a support surface on the deck and positioned at the stern of the watercraft;

a first abutment secured to the deck on a longitudinal centerline of the watercraft and protruding from the support surface; and a second abutment secured to the deck to one side of the longitudinal centerline, one of the first and second abutments being disposed closer to the stern of the watercraft than the other one of the first and second abutments, such that a water sport implement laid on the support surface may be held captive between the first and second abutments to aid a performer in putting on the water sport implement.

13. The watercraft of claim 12, further comprising a third abutment secured to the deck to another side of the longitudinal centerline.

14. The watercraft of claim 13, wherein a distance between the stern and the third abutment is equal to a distance between the stern and the second abutment.

* * * * *